US005198410A

United States Patent [19]

Martin

[11] Patent Number: 5,198,410

[45] Date of Patent: Mar. 30, 1993

[54] THERMAL DYE TRANSFER RECEIVING ELEMENT WITH BACKING LAYER

[75] Inventor: Thomas W. Martin, Rochester, N.Y.

[73] Assignee: Eastman Kodak Company, Rochester, N.Y.

[21] Appl. No.: 838,618

[22] Filed: Feb. 19, 1992

[51] Int. Cl.[5] ..... B41M 5/035

[52] U.S. Cl. ..... 503/227; 8/471; 428/195; 428/211; 428/327; 428/331; 428/913; 428/914

[58] Field of Search ..... 503/227; 8/471; 428/195, 211, 327, 331, 913, 914, 323

[56] References Cited

U.S. PATENT DOCUMENTS

| | | | |
|---|---|---|---|
| 4,814,321 | 3/1989 | Campbell | 503/227 |
| 4,820,686 | 4/1989 | Ito et al. | 503/227 |
| 4,828,971 | 5/1989 | Przezdziecki | 430/531 |
| 5,011,814 | 4/1991 | Harrison | 503/227 |
| 5,075,164 | 12/1991 | Bowman et al. | 428/325 |
| 5,096,875 | 3/1992 | Martin | 503/227 |

FOREIGN PATENT DOCUMENTS

| | | |
|---|---|---|
| 0351075 | 1/1990 | European Pat. Off. . |
| 1-47586 | 2/1989 | Japan . |

*Primary Examiner*—Pamela R. Schwartz
*Attorney, Agent, or Firm*—Andrew J. Anderson

[57] ABSTRACT

A dye-receiving element for thermal dye transfer includes a support having on one side thereof a polymeric dye image-receiving layer and on the other side thereof a backing layer made from a mixture of an organo-clay binder, submicron colloidal inorganic particles, and polymeric particles of a size larger than the inorganic particles.

20 Claims, No Drawings

THERMAL DYE TRANSFER RECEIVING ELEMENT WITH BACKING LAYER

This invention relates to dye-receiving elements used in thermal dye transfer, and more particularly to the backing layer of such elements.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

Dye receiving elements for thermal dye transfer generally include a support bearing on one side thereof a dye image-receiving layer and on the other side thereof a backing layer. As set forth in U.S. Pat. No. 5,011,814 of Harrison, the disclosure of which is incorporated by reference, the backing layer material is chosen to (1) provide adequate friction to a thermal printer rubber pick roller to allow for removal of one receiver element at a time from a thermal printer receiver element supply stack, (2) minimize interactions between the front and back surfaces of receiving elements such as dye retransfer from one imaged receiving element to the backing layer of an adjacent receiving element in a stack of imaged elements, and (3) minimize sticking between a dye-donor element and the receiving element backing layer when the receiving element is accidentally inserted into a thermal printer wrong side up.

One backing layer which has found use for dye-receiving elements is a mixture of polyethylene glycol (a double-end hydroxy terminated ethylene oxide polymer) and submicron colloidal silica. This backing layer functions well to minimize interactions between the front and back surfaces of receiving elements and to minimize sticking to a dye-donor element when the receiving element is used wrong side up. This backing layer also provides adequate friction to a rubber pick roller to allow removal of receiving elements from a stack under normal room temperature conditions (20° C., 50% relative humidity). At higher temperatures and relative humidity, e.g. tropical conditions (30° C., 91% relative humidity), however, this backing layer becomes too lubricious and does not allow for effective removal of receiving elements from the supply stack.

U.S. Pat. No. 5,011,814 referred to above discloses a backing layer comprising a mixture of polyethylene oxide (a single-end hydroxy terminated ethylene oxide polymer) and submicron colloidal inorganic particles. By using polyethylene oxide in place of polyethylene glycol in the backing layer mixture, adequate friction is achieved between a rubber pick roller and the backing layer to allow for removal of receiver elements from a supply stack even under high temperature and relative humidity conditions.

Commonly assigned U.S. Pat. No. 5,096,875 of Marlin, the disclosure of which is incorporated by reference, discloses an improvement over U.S. Pat. No. 5,011,814 wherein polymeric particles of a size larger than the inorganic particles are added to the polyethylene oxide and submicron colloidal inorganic particle containing receiver element backing layer in order to prevent "blocking" or multiple feeding of receiver elements which occasionally results due to too high friction between adjacent receiver elements in the supply stack when using receiver elements having such backing layers.

Polyethylene oxide backing layers, however, have been found to be not as resistant to dye retransfer as would be desirable. It would be desirable to provide a backing layer for a dye-receiving element which would minimize interactions between the front and back surfaces of such elements, minimize sticking to a dye-donor element, provide adequate friction to a thermal printer rubber pick roller to allow for removal of receiver elements from a receiver element supply stack, and control friction between adjacent receiver elements in the supply stack so as to prevent simultaneous multiple feeding of the receiver elements.

These and other objects are achieved in accordance with this invention which comprises a dye-receiving element for thermal dye transfer comprising a support having on one side thereof a polymeric dye image-receiving layer and on the other side thereof a backing layer, wherein the backing layer comprises a mixture of an organo-clay, submicron colloidal inorganic particles, and polymeric particles of a size larger than the inorganic particles.

The process of forming a dye transfer image in a dye-receiving element in accordance with this invention comprises removing an individual dye-receiving element as described above from a supply stack of dye-receiving elements, moving the individual receiving element to a thermal printer printing station and into superposed relationship with a dye-donor element comprising a support having thereon a dye-containing layer so that the dye-containing layer of the donor element faces the dye image-receiving layer of the receiving element, and imagewise heating the dye-donor element thereby transferring a dye image to the individual receiving element. The process of the invention is applicable to any type of thermal printer, such as a resistive head thermal printer, a laser thermal printer, or an ultrasound thermal printer.

In accordance with this invention, adding a polymeric particulate material of the indicated size decreases the sliding friction between adjacent receiving elements in a supply stack to a greater extent than the picking friction between the backing layer and a rubber pick roller. As a result, blocking or multiple feeding is controlled while adequate picking friction is maintained. Using an organo-clay in the backing layer mixture results in maintaining adequate friction between the rubber pick roller and the backing layer even under high temperature and relative humidity conditions.

while reducing dye retransfer between stacked imaged elements.

For the purposes of this invention, the term "organo-clay" is intended to describe organic modified clays which are commonly used as thickening or thixotropic viscosifying agents. Such organo-clays are widely commercially available, and may comprise mixtures of a compatible organic compound (such as hydroxyethylcellulose) and a smectite-type clay (such as montmorillonite, bentonite, and hectorite clays), or may take the form of "organophilic clays", i.e. clays in which the inorganic cations associated with the clay have been displaced by organic cations such as an organic ammonium cation. The cation of the salt used to react with the clay may include radicals such as dodecylammonium, octadecylammonium, didodecylammonium, dihexadecylammonium, tetradecylbenzylammonium, methydioctadecylammonium, dibenzyldodecylammonium, dimethyldioctadecylammonium, methylbenzyldihexadecylammonium, and the like. One particularly useful quaternary ammonium salt which is common in many commercial organophilic clay formulations is dimethyl dihydrogenated tallow ammonium chloride. Illustrative of the numerous patents which describe organic cationic salts, their manner of preparation and their use in the preparation of organophilic clays are U.S. Pat. Nos. 2,966,506, 4,081,496, 4,105,578, 4,116,866, 4,208,218, 4,391,637, 4,410,364, 4,412,018, 4,434,075, 4,434,076, 4,450,095, 4,517,112, and 4,695,402, the contents of which are incorporated by reference. Specific examples of commercially available organo-clays include Bentone-LT of NL Industries, Inc., and Tixogel VZ, EZ-200, and MP-200 of United Catalysts, Inc.

Other polymeric binders (e.g., polyethylene glycol, polyethylene oxide, and polyvinyl alcohol) may be used in combination with the organo-clay. Preferably, the amount of organo-clay in the backing layer is from about 0.02 to 0.2 g/m$^2$, more preferably from about 0.05 to 0.1 g/m$^2$, and comprises from about 5 to about 25 wt. %, more preferably from about 10 to 20 wt. %, of the backing layer.

The submicron colloidal inorganic particles preferably comprise from about 45 to about 85 wt. % of the backing layer mixture of the invention. While any submicron colloidal inorganic particles may be used, the particles preferably are water dispersible and less than 0.1 μm in size, and more preferably from about 0.01 to 0.05 μm in size. There may be used, for example, silica, alumina, titanium dioxide, barium sulfate, etc. In a preferred embodiment, silica particles are used.

The polymeric particles may in general comprise any organic polymeric material, and preferably comprise from about 1 to 35 wt. % of the backing layer mixture. Inorganic particles are in general too hard and are believed to dig into the receiving layer of adjacent receiver elements in a supply stack, preventing such particles from effectively controlling the sliding friction between adjacent receiver elements. Particularly preferred polymeric particles are cross-linked polymers such as polystyrene cross-linked with divinylbenzene, and fluorinated hydrocarbon polymers. The polymeric particles are preferably from about 1 μm to about 15 μm in size, and particles from about 3 μm to about 12 μm are particularly preferred. The polymeric particles are preferably present at a coverage from about 0.01 to about 0.35 g/m$^2$.

Additional materials may also be added to the backing layer. For example, improved pencil writeability can be obtained, if desired, by the addition of calcined clay. Calcined clays are essentially aluminum silicates that have been heated to remove water of hydration. These materials generally have a particle size of 0.5 to 4 μm, preferably 1 to 2 μm, and may be added at up to 60%, preferably 30–40%, by weight of the backing layer to provide improved writability. Commercially available materials and their average particle size include: Satintone Special (Engelhard Industries), approx 1.2 μm; Icecap K (Burgess Pigment), approx. 1.0 μm; Altowhite LL (Georgia Kaolin), approx. 1.8 μm; and Glomax JDF (Georgia Kaolin), approx. 0.9 μm. Ionic antistat agents may also be added to the backing layer. Surfactants and other conventional coating aids may also be used in the backing layer coating mixture.

The backing layer may be present in any amount which is effective for the intended purpose. In general, good results have been obtained at a total coverage of from about 0.1 to about 2.5 g/m$^2$. Total coverages of from about 0.5 to about 1.5 g/m$^2$ are preferred.

The support for the dye-receiving element of the invention may be transparent or opaque, and may be, for example, a polymeric, a synthetic paper, or a cellulosic paper support, or laminates thereof. In a preferred embodiment, a paper support is used for receiving elements for reflective viewing. In a further preferred embodiment, a polymeric layer is present between the paper support and the dye image-receiving layer. For example, there may be employed a polyolefin such as polyethylene or polypropylene. In a further preferred embodiment, white pigments such as titanium dioxide, zinc oxide, etc., may be added to the polymeric layer to provide reflectivity. In addition, a subbing layer may be used over this polymeric layer to improve adhesion to the dye image-receiving layer. In a further preferred embodiment, a polymeric layer such as a polyolefin layer may also be present between the paper support and the backing layer, e.g. to prevent curl. Transparent supports may be used for forming images for transparency viewing. For transparencies, the addition of an ionic antistat agent to the backing layer, such as potassium chloride, vanadium pentoxide, or others known in the art, is also desirable.

The dye image-receiving layer of the receiving elements of the invention may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at from about 1 to about 10 g/m$^2$. An overcoat layer may be further coated over the dye-receiving layer, such as described in U.S. Pat. No. 4,775,657 of Harrison et al., the disclosure of which is incorporated by reference.

Conventional dye-donor elements may be used with the dye-receiving element of the invention. Such donor elements generally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803 and 5,023,228, the disclosures of which are incorporated by reference.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. No. 4,541,830.

In a preferred embodiment of the invention, a dye-donor element is employed which comprises a poly(ethylene terephthalate) support coated with sequential repeating areas of cyan, magenta and yellow dye, and the dye transfer process steps are sequentially performed for each color to obtain a three-color dye transfer image.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer, such as laser or ultrasound, may be used.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to further illustrate the invention.

EXAMPLE 1

Dye-receivers were prepared by coating the following layers in order on white-reflective supports of titanium dioxide pigmented polyethylene overcoated paper stock:

(1) Subbing layer of poly(acrylonitrile-co-vinylidene chloride-co acrylic acid) (14:79:7 wt. ratio) (0.08 g/m$^2$) coated from butanone solvent.

(2) Dye-receiving layer of diphenyl phthalate (0.32 g/m$^2$), di-n-butyl phthalate(0.32 g/m$^2$), Fluorad FC-431 ® (a perfluorosulfonamido surfactant of 3M Corp.) (0.01 g/m$^2$), Makrolon 5700 ® (a bisphenol-A polycarbonate of Bayer AG) (1.6 g/m$^2$), and a linear condensation polymer derived from carbonic acid, bisphenol-A, and diethylene glycol (phenol:glycol mol ratio 50:50, mw approx. 17,000)(1.6 g/m$^2$) coated from dichloromethane solvent.

(3) Overcoat layer of Fluorad FC-431 ® (a perfluorosulfonamido surfactant of 3M Corp.) (0.02 g/m$^2$), 510 ® Silicone Fluid (a partial phenyl substituted polydimethylsiloxane of Dow Corning) (0.02 g/m$^2$) in the linear condensation polymer described above (0.22 g/m$^2$) coated from dichloromethane solvent.

On the reverse (back) side of these supports a layer of high-density polyethylene (32 g/m$^2$) was extrusion coated. On top of this layer, backing layers of the invention or comparison backing layers were coated from a water and isobutyl alcohol solvent mixture. The backing layers contained Bentone LT (an organo-clay from NL Industries), colloidal silica (LUDOX AM ® alumina modified colloidal silica of duPont) of approximately 0.014 μm diameter, and polystyrene beads cross-linked with m- and p-divinylbenzene of average diameter 4 μm. For coating ease, all backing layers also contained Triton X200E ® (a sulfonated aromatic-aliphatic surfactant of Rohm and Haas) and Daxad-30 ® (sodium polymethacrylate of W. R. Grace Chem. Co.).

The following backing layers and controls were prepared:

| | |
|---|---|
| Invention Backing Layer E-1: | |
| Bentone LT | 0.084 g/m$^2$ |
| Ludox AM | 0.36 g/m$^2$ |
| Polystyrene beads | 0.028 g/m$^2$ |
| Triton X200E | 0.001 g/m$^2$ |
| Daxad 30 | 0.056 g/m$^2$ |
| Invention Backing Layer E-2: | |
| Bentone LT | 0.096 g/m$^2$ |
| Ludox AM | 0.60 g/m$^2$ |
| Polystyrene beads | 0.096 g/m$^2$ |
| Triton X200E | 0.017 g/m$^2$ |
| Daxad 30 | 0.096 g/m$^2$ |
| Invention Backing Layer E-3: | |
| Bentone LT | 0.058 g/m$^2$ |
| Ludox AM | 0.73 g/m$^2$ |
| Polystyrene beads | 0.17 g/m$^2$ |
| Triton X200E | 0.022 g/m$^2$ |
| Daxad 30 | 0.12 g/m$^2$ |

A control backing layer based on U.S. Pat. No. 5,011,814 of Harrison containing colloidal silica and polyethylene oxide was also prepared:

| Control Backing Layer C-1: | |
|---|---|
| Polyox WSRN-10 (a polyethyleneoxide of mw 100,000) (Union Carbide) | 0.13 g/m$^2$ |
| Ludox AM | 0.86 g/m$^2$ |
| Triton X200E | 0.019 g/m$^2$ |
| Daxad 30 | 0.089 g/m$^2$ |

A second control backing layer based on U.S. Ser. No. 547,580 of Martin containing large particles of polystyrene, small particles of colloidal silica, and polyethylene oxide was also prepared:

| Control Backing Layer C-2: | |
|---|---|
| Ludox AM | 0.70 g/m$^2$ |
| Polystyrene beads | 0.22 g/m$^2$ |
| Polyox WSRN-10 (a polyethyleneoxide of mw 100,000) (Union Carbide) | 0.13 g/m$^2$ |
| Triton X200E | 0.019 g/m$^2$ |
| Daxad 30 | 0.033 g/m$^2$ |

To evaluate receiver backing layer to rubber pick roller friction, each dye receiver tested was placed face down (dye image-receiving layer side down) on top of a stack of face down receivers. Two pick rollers (12 mm wide and 28 mm in diameter with an outer 2 mm layer of Kraton G2712X rubber) of a commercial thermal printer (Kodak SV6500 Color Video Printer) were lowered onto the top test receiver so as to come into contact with the backing layer to be tested. The rollers were stalled at a fixed position so that they could not rotate, and supplied a normal force of approximately 4N (400 g) to the receiver backing layer. A spring type force scale (Chatillon 2 kg×26 scale) was attached to the test receiver and was used to pull it at a rate of 0.25 cm/sec from the receiver stack. The required pull forces for the various backing layers were measured at high humidity, 90% RH, as the receivers began to slide and are indicated in Table I below. In actual practice, it has been found that pull forces of at least about 6N (600 g) or more are preferable to ensure good picking reliability.

To evaluate sliding friction between the backing layer of one receiver element and the receiving layer of an adjacent element, a first receiver element was taped to a stationary support with the backing layer facing up. A second receiver element was then placed with its receiving layer face down against the backing layer of the first element. A 1.5 kg steel weight was placed over the two receiver elements, covering an area approximately 10 cm by 12 cm. A cam driven strain gauge was attached to the second (upper) receiver element and advanced about two cm at a rate of 0.25 cm/sec. The maximum pull forces for the various receivers were measured at about 1 sec into the pull and are indicated in Table I below. In actual practice, it has been found that the pull forces of less than about 5N (500 g) are desirable to prevent blocking or multiple feeding.

To evaluate backside dye-retransfer between the printed receiving layer side of one dye-receiver element and the back of a second dye-receiver an image consisting of a series of individual cyan, magenta, and yellow dye areas was printed by means of a thermal-head as described in Example 2 of U.S. Pat. No. 4,927,803. The transferred Status A reflection densities were approximately 1.0 for each area.

The face of the printed receiver was placed in contact with the backing layer of another unprinted test receiver, placed between two flat metal supports with a 1 kg weight on top, and the assembly was incubated for one week at 50° C., 50% RH. After this time the areas of the test backing that were in contact with the printed areas were read to Status A Red, Green, or Blue reflection density. The background density of an unprinted area was subtracted from each value to obtain the net amount of transferred dye density, which is indicated in Table I below.

TABLE I

| Receiver Element | Picking Friction (Newtons) | Sliding Friction (Newtons) | Retransferred Dye Density Status A-Above Background | | |
|---|---|---|---|---|---|
| | | | Red | Green | Blue |
| C-1 | 4.2 | 6.2 | 0.05 | 0.03 | 0.07 |
| C-2 | 7.0 | 3.8 | 0.03 | 0.01 | 0.08 |
| E-1 | 7.2 | 4.1 | 0.02 | 0.03 | 0. |
| E-2 | 7.2 | 4.0 | 0.03 | 0.03 | 0.02 |
| E-3 | 6.1 | 4.2 | 0.01 | 0.03 | 0.01 |

The data above show that the backing layers of the invention which contain the organo-clay have excellent high humidity picking friction and sliding friction characteristics compared to the prior art control without large particles.

In addition the invention backing layers have significantly less backside dye-retransfer compared to the controls without the organo-clay.

The invention has been described in detail with particular reference to preferred embodiments thereof, but it will be understood that variations and modifications can be effected within the spirit and scope of the invention.

What is claimed is:

1. In a dye-receiving element for thermal dye transfer comprising a support having on one side thereof a polymeric dye image-receiving layer and on the other side thereof a backing layer, the improvement wherein said backing layer comprises a mixture of an organo-clay binder, submicron colloidal inorganic particles, and polymeric particles of a size larger than the inorganic particles.

2. The element of claim 1, wherein said support comprises paper.

3. The element of claim 2, further comprising a polyolefin layer between said support and said backing layer.

4. The element of claim 1, wherein the submicron colloidal inorganic particles comprise silica.

5. The element of claim 1, wherein the organo-clay comprises from about 5 to 25 wt. % of the backing layer.

6. The element of claim 1, wherein the total coverage of the backing layer is from 0.1 to 2.5 g/m$^2$.

7. A dye-receiving element for thermal dye transfer comprising a support having on one side thereof a polymeric dye image-receiving layer and on the other side thereof a backing layer, wherein said backing layer comprises a mixture of 5 to 25 wt. % of an organo-clay binder, 45 to 85 wt. % submicron colloidal inorganic particles of a size from 0.01 to 0.05 μm, and 1 to 35 wt. % polymeric particles of a size from 1 to 15 μm.

8. The element of claim 7, wherein said support comprises paper.

9. The element of claim 8, further comprising a polyolefin layer between said support and said backing layer.

10. The element of claim 7, wherein the submicron colloidal inorganic particles comprise silica.

11. The element of claim 7, wherein the total coverage of the backing layer is from 0.1 to 2.5 g/m$^2$.

12. The element of claim 7, wherein the total coverage of the backing layer is from 0.5 to 1.5 g/m$^2$ wherein said backing layer comprises from 10 to 20 wt. % of an organo-clay binder.

13. In a process of forming a dye transfer image in a dye-receiving element comprising:

(a) removing an individual dye-receiving element comprising a support having on one side thereof a polymeric dye image-receiving layer and on the other side thereof a backing layer from a stack of dye-receiving elements;

(b) moving said individual dye-receiving element to a thermal printer printing station and into superposed relationship with a dye-donor element comprising a support having thereon a dye-containing layer so that the dye-containing layer of the donor element faces the dye image-receiving layer of the receiving element; and (c) imagewise-heating said dye-donor element and thereby transferring a dye image to said individual dye-receiving element; the improvement wherein said backing layer comprises a mixture of an organo-clay binder, submicron colloidal inorganic particles, and polymeric particles of a size larger than the inorganic particles.

14. The process of claim 13, wherein said support comprises paper.

15. The process of claim 14, further comprising a polyolefin layer between said support and said backing layer.

16. The process of claim 13, wherein the submicron colloidal inorganic particles comprise silica.

17. The process of claim 13, wherein the organo-clay comprises from about 5 to 25 wt. % of the backing layer.

18. The process of claim 13, wherein the total coverage of the backing layer is from 0.1 to 2.5 $g/m^2$.

19. The process of claim 13, wherein said backing layer comprises a mixture of 5 to 25 wt. % of an organo-clay binder, 45 to 85 wt. % submicron colloidal inorganic particles of a size from 0.01 to 0.05 μm, and 1 to 35 wt. % polymeric particles of a size from 1 to 15 μm.

20. The process of claim 19, wherein the total coverage of the backing layer is from 0.1 to 2.5 $g/m^2$.

* * * * *